US006866724B2

(12) United States Patent
Ochi et al.

(10) Patent No.: US 6,866,724 B2
(45) Date of Patent: Mar. 15, 2005

(54) STEEL BAR OR WIRE ROD FOR COLD FORGING AND METHOD OF PRODUCING THE SAME

(75) Inventors: Tatsuro Ochi, Muroran (JP); Hideo Kanisawa, Muroran (JP); Ken-ichiro Naito, Muroran (JP)

(73) Assignee: Nippon Steel Corporation, Tokyo (JP)

( * ) Notice: Subject to any disclaimer, the term of this patent is extended or adjusted under 35 U.S.C. 154(b) by 141 days.

(21) Appl. No.: 10/168,650

(22) PCT Filed: Dec. 22, 2000

(86) PCT No.: PCT/JP00/09165

§ 371 (c)(1),
(2), (4) Date: Jun. 21, 2002

(87) PCT Pub. No.: WO01/48257

PCT Pub. Date: Jul. 5, 2001

(65) Prior Publication Data

US 2003/0075250 A1 Apr. 24, 2003

(30) Foreign Application Priority Data

Dec. 24, 1999 (JP) ..... 11-366552
Aug. 30, 2000 (JP) ..... 2000-261688

(51) Int. Cl.[7] ..... C22C 38/02; C21D 8/06

(52) U.S. Cl. ..... 148/320; 148/333; 148/334; 148/335; 148/336; 148/595; 148/598; 148/599

(58) Field of Search ..... 148/320, 333–336, 148/595, 598, 599, 330

(56) References Cited

U.S. PATENT DOCUMENTS 6,602,359 B1 * 8/2003 Ichi et al. ..... 148/330

FOREIGN PATENT DOCUMENTS

| | | |
|---|---|---|
| EP | 0 508 237 | 10/1992 |
| JP | 62-139817 | 6/1987 |
| JP | 7-34184 | 2/1995 |
| JP | 7-268546 | 10/1995 |
| JP | 9-287056 | 11/1997 |

OTHER PUBLICATIONS

Toshizo Tarui, et al., "Chokusetsu Nanshitsuka Senzai no Kyoudo Ensei no oyobosu Goukin Genso no Eikyou", Zairyou to Process, vol. 4 (1991) No. 3–2040.

* cited by examiner

*Primary Examiner*—Deborah Yee
(74) *Attorney, Agent, or Firm*—Kenyon & Kenyon

(57) ABSTRACT

A bar or wire product for use in cold forging, characterized in that it comprises a steel having the chemical composition, in mass %: C: 0.1 to 0.6%, Si: 0.01 to 0.5%, Mn: 0.2 to 1.7%, S: 0.001 to 0.15%, Al: 0.015 to 0.05%, N: 0.003 to 0.025%, P: 0.035% or less, O: 0.003% or less and balance: Fe and inevitable impurities, and it has, in the region from the surface thereof to the depth of the radius thereof×0.15, a structure wherein ferrite accounts for 10 area % or less and the balance is substantially one or more of martensite, bainite and pearlite, and the average hardness in the region from the depth of the radius thereof×0.5 to the center thereof is less than that of the surface layer thereof by 20 or more of HV; and a method for producing the bar or wire product. The bar or wire product is excellent in the ductility after spheroidizing and thus allows the prevention of occurrence of cracks in a steel product during cold forging, which has conventionally been a problem in manufacturing structural parts for a machine by cold forging.

8 Claims, 5 Drawing Sheets

25μm

25μm

STEEL BAR OR WIRE ROD FOR COLD FORGING AND METHOD OF PRODUCING THE SAME

TECHNICAL FIELD

The present invention relates to a steel bar or wire rod, for cold forging, used for manufacturing machine structural components such as the components of cars, construction machines and the like, and to a method of producing the same and, more specifically, to a steel bar or wire rod, for cold forging, excellent in ductility and thus being suitable for heavy cold forging work, and a method of producing the same.

BACKGROUND ART

Carbon steels for machine structural use and low alloy steels for machine structural use have been used conventionally as the structural steels for the manufacture of machine structural components such as the components of cars, construction machines and the like. The machine structural components for cars such as bolts, rods, engine components and driving system components have so far been manufactured from these steel materials mainly through a hot forging and machining process. However, the recent trend is that the above hot forging and machining process is replaced with a cold forging process in view of advantages such as the improvement of productivity. In a cold forging process, cold forging work is usually applied to a hot rolled steel material after it is subjected to spheroidizing annealing (SA) and cold workability is secured. A problem here is that the cold forging causes work hardening of the steel material and its ductility is lowered, resulting in the occurrence of cracks and a shorter service life of metal dies. The occurrence of cracks during the cold forging work, or the insufficiency of steel ductility, often constitutes the main obstacle in the change from a hot forging process to a cold forging process, especially when heavy cold forging is required.

Meanwhile, in the spheroidizing annealing (SA), a steel material has to be heated to a high temperature and held there for a long time and, consequently, an apparatus for heat treatment such as a heating furnace is required and, in addition, energy is consumed for the heating and, for this reason, the spheroidizing annealing is responsible for a large proportion of the manufacturing cost. In view of the above, various technologies, such as those described below, have been proposed for the purposes of enhancing productivity, saving energy, etc.

For the purpose of reducing the time for the spheroidizing annealing, Japanese Unexamined Patent Publication No. S57-63638 proposes a method for obtaining a steel wire rod excellent in cold forging properties by cooling a hot-rolled steel material to 600° C., at a cooling rate of 4° C./sec. or higher, to form a quenched structure and then applying spheroidizing annealing to the steel material covered with scale in an inert gas atmosphere. For enabling quick spheroidizing, Japanese Unexamined Patent Publication No. S60-152627 discloses a method in which finish rolling conditions are specifically defined and a steel material is rapidly cooled after the rolling to obtain a structure where fine pearlite, bainite or martensite is mixed in finely dispersed pro-eutectoid ferrite. Japanese Unexamined Patent Publication No. S61-264158 proposes a method for lowering the steel hardness after spheroidizing annealing by improving the chemical composition of a steel, namely by obtaining a low carbon steel wherein the content of P is reduced to 0.005% or less and the expressions Mn/S≧1.7 and Al/N≧4.0 are satisfied. Japanese Unexamined Patent Publication No. S60-114517 proposes a method in which controlled rolling is applied for the purpose of eliminating a softening annealing process before cold working.

All these conventional technologies aim at improving or eliminating the spheroidizing annealing before the cold forging work and do not aim at improving the insufficient ductility of steel materials, which constitutes the main obstacle in the change from a hot forging process to a cold forging process in the manufacture of machine components requiring heavy working.

DISCLOSURE OF THE INVENTION

In view of the above situation, the object of the present invention is to provide a steel bar or wire rod for cold forging excellent in ductility after spheroidizing annealing, capable of preventing, in the manufacture of machine structural components from a hot-rolled steel bar or wire rod through spheroidizing annealing and cold forging, the conventional problem of cracking of a steel material during cold forging work, and a method of producing the same.

As a result of investigations into the cold workability of a steel bar or wire rod for cold forging, the inventors of the present invention discovered that it was possible to obtain a steel bar or wire rod for cold forging excellent in ductility after spheroidizing annealing by hardening only the surface layer of a steel bar or wire rod having a specific chemical composition and forming a soft structure in its center portion.

The gist of the present invention, which has been established on the basis of the above finding, is as follows:

(1) A steel bar or wire rod for cold forging excellent in ductility after spheroidizing annealing, characterized by: consisting of a steel containing, in mass,
0.1 to 0.6% of C,
0.01 to 0.5% of Si,
0.2 to 1.7% of Mn,
0.001 to 0.15% of S,
0.015 to 0.05% of Al and
0.003 to 0.025% of N,
and having the contents of P and O controlled to 0.035% or less and 0.003% or less, respectively, with the balance consisting of Fe and unavoidable impurities; the area percentage of ferrite in the metallographic structure of the portion from the surface to the depth of 0.15 of its radius being 10% or less, with the rest of the structure consisting substantially of one or more of martensite, bainite and pearlite; and the average hardness of the portion from the depth of 0.5 of its radius to the center being lower than that of its surface layer (the portion from the surface to the depth of 0.15 of the radius) by HV 20 or more.

(2) A steel bar or wire rod for cold forging excellent in ductility after spheroidizing annealing according to the item (1), characterized by further containing, in mass, one or more of 3.5% or less of Ni, 2% or less of Cr and 1% or less of Mo.

(3) A steel bar or wire rod for cold forging excellent in ductility after spheroidizing annealing according to the item (1) or (2), characterized by further containing, in mass, one or more of 0.005 to 0.1% of Nb and 0.03 to 0.3% of V.

(4) A steel bar or wire rod for cold forging excellent in ductility after spheroidizing annealing according to any one of the items (1) to (3), characterized by further containing, in mass, one or more of 0.02% or less of Te, 0.02% or less of Ca, 0.01% or less of Zr, 0.035% or less of Mg, 0.1% or less of Y and 0.15% or less of rare earth elements.

(5) A steel bar or wire rod for cold forging excellent in ductility after spheroidizing annealing according to any one of the items (1) to (4), characterized in that the austenite grain size number according to Japanese Industrial Standard (JIS) in the portion from the surface to the depth of 0.15 of its radius is 8 or higher.

(6) A method of producing a steel bar or wire rod for cold forging excellent in ductility after spheroidizing annealing, characterized by: finish-rolling a steel material having a chemical composition specified in any one of the items (1) to (5) while controlling its surface temperature to 700 to 1,000° C. at the exit from the final finish rolling stand, during hot rolling, and, after that, subjecting the rolled material to at least a process cycle of "rapidly cooling the hot rolled material to a surface temperature of 600° C. or below and subsequently making it recuperate by the sensible heat thereof so that the surface temperature becomes 200 to 700° C." or repeating the process cycle twice or more; and, by doing so, making the area percentage of ferrite in the structure of the portion of the steel bar or wire rod from the surface to the depth of 0.15 of its radius 10% or less, and the rest of the structure consist substantially of one or more of martensite, bainite and pearlite, and also, forming the structure in which the average hardness of the portion from the depth of 0.5 of its radius to the center is lower than that of its surface layer (the portion from the surface to the depth of 0.15 of the radius) by HV 20 or more.

(7) A steel bar or wire rod for cold forging excellent in ductility characterized by: being a steel bar or wire rod according to any one of the items (1) to (5) having undergone spheroidizing annealing; the degree of spheroidized structure according to JIS G 3539 in the portion from the surface to the depth of 0.15 of its radius being No. 2 or below; and the degree of spheroidized structure in the portion from the depth of 0.5 of its radius to the center being No. 3 or below.

(8) A steel bar or wire rod for cold forging excellent in ductility according to the item (7), characterized in that the ferrite grain size number under JIS in the portion from the surface to the depth of 0.15 of its radius is 8 or higher.

BEST MODE FOR CARRYING OUT THE INVENTION

Figure 1:
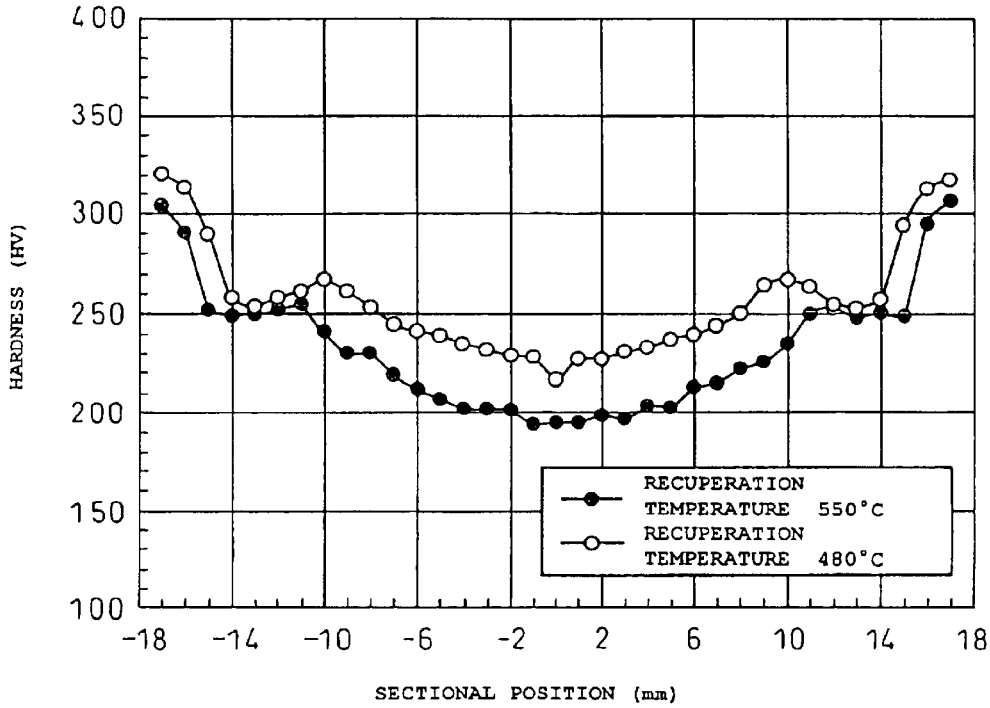
FIG. 1 is a graph showing the relation between the position (mm) in a section of a steel bar 36 mm in diameter for cold forging according to the present invention and the hardness (HV) at the position.

The present invention will be explained in detail hereafter.

In the first place, the reasons are given as to why the steel chemical composition necessary for achieving the structure and the mechanical properties such as the hardness and ductility of a steel bar or wire rod for cold forging, which are targeted in the present invention, is specified.

C: C is an element indispensable for the enhancement of the steel strength required of machine structural components. With a C content less than 0.1%, the strength of a final product is insufficient but, with a C content in excess of 0.6%, the ductility of a final product is deteriorated. The C content is, therefore, limited to 0.1 to 0.6%.

Si: Si is added as a deoxidizing agent and also for the purpose of increasing the strength of a final product through solid solution hardening. A content of Si below 0.01% is insufficient for obtaining the above effects. However, when it is added in excess of 0.5%, these effects do not increase any more and, rather, the ductility is deteriorated. For this reason, the content of Si is defined to be 0.01 to 0.5%. It is, however, preferable to set the upper limit of the Si content at 0.35% or lower or, more preferably, at 0.2% or lower.

Mn: Mn is an element effective for increasing the strength of a final product through the enhancement of hardenability. With a Mn content less than 0.2%, a sufficient effect is not obtained and, with its addition in excess of 1.7%, not only the effect becomes saturated but also ductility is deteriorated. The Mn content is, therefore, limited to 0.2 to 1.7%.

S: S is a component inevitably included in steel and exists there in the form of MnS. Its content is defined in the present invention to be 0.001 to 0.15% because S is effective for enhancing machinability and fining a crystal structure. However, as S is detrimental to cold forming work, it is preferable to limit its content to 0.015% or lower or, more preferably, to 0.01% or lower, when machinability is not required.

Al: Al is effective as a deoxidizing agent. It is also effective for fining crystal grains by fixing solute N in steel as AlN. With an excessive content of Al, however, an excessive amount of $Al_2O_3$ is formed, resulting in an increase of internal defects and the deterioration of cold workability. The content of Al is therefore limited within the range from 0.015 to 0.05% in the present invention.

N: N reacts with Al or Nb to form AlN or NbN (NbCN), fines crystal grains and enhances steel ductility and, for this reason, its content is set at 0.003 to 0.025%.

P: P is a component inevitably included in steel and causes grain boundary segregation and center segregation, deteriorating ductility. It is, therefore, desirable to limit the content of P to 0.035% or less or, preferably, 0.02% or less.

O: O is a component inevitably included in steel too, and deteriorates cold workability by reacting with Al to form $Al_2O_3$. It is therefore desirable to control its content to 0.003% or lower or, preferably, 0.002% or lower.

The basic chemical composition of a steel to which the present invention is applied is as explained above. Further, in the present invention, a steel may contain one or more of Ni, Cr and Mo. These elements are added for increasing the strength of a final product through the enhancement of hardenability and similar effects. An addition of each of these elements in a great quantity, however, causes bainite and martensite to form down to the center portion of an as hot-rolled steel bar or wire rod, raising steel hardness, and is not desirable from the economical viewpoint, either. The contents of these elements, therefore, are limited to 3.5% or less for Ni, 2% or less for Cr, and 1% or less for Mo.

Yet further, in the present invention, for the purpose of controlling the crystal grain size, Nb and/or V may be added to a steel. When the content of Nb is below 0.005% or that of V is below 0.03%, however, a tangible effect is not obtained. On the other hand, when their contents exceed 0.1 and 0.3%, respectively, the effect is saturated and, rather, the ductility is deteriorated. Hence, their contents are defined to be 0.005 to 0.1% for Nb and 0.03 to 0.3% for V.

In addition, in the present invention, for the purposes of controlling the shape of MnS, preventing cracks and enhancing ductility, a steel may contain one or more of the following elements: 0.02% or less of Te, 0.02% or less of Ca, 0.01% or less of Zr, 0.035% or less of Mg, 0.15% or less of rare earth elements, and 0.1% or less of Y. These elements form respective oxides, and the oxides not only act as nuclei for the formation of MnS but also reform MnS into (Mn, Ca)S, (Mn, Mg)S, etc. This makes the sulfides easily stretchable during hot rolling, causing granular MnS to disperse in fine grains, which increases ductility as well as the critical upsetting ratio during cold forging work. On the other hand, when Te is added in excess of 0.02%, Ca in excess of 0.02%, Zr in excess of 0.01%, Mg in excess of 0.035%, Y in excess of 0.1%, or rare earth elements in excess of 0.15%, the above effects are saturated and, adversely, CaO, MgO and other coarse oxides and the clusters of these oxides are formed, and hard compounds such as ZrN and the like precipitate, deteriorating ductility. For this reason, the contents of these elements are defined to be 0.02% or less for Te, 0.02% or less for Ca, 0.01% or less for Zr, 0.035% or less for Mg, 0.1% or less for Y, and 0.15% or less for rare earth elements. Note that the rare earth elements described in the present invention mean elements having atomic numbers of 57 to 71.

Here, the Zr content in steel is determined by the inductively coupled plasma emission spectrometry (ICP), in a manner similar to the determination of the content of Nb in steel, after a sample is treated in the same manner as specified in Attachment 3 of JIS G 1237-1997. The amount of each sample used in the measurement of Example of the present invention was 2 g per steel grade and a calibration curve for the ICP was set so as to be suited for measuring a very small quantity of Zr. That is to say, solutions having different Zr concentrations were prepared by diluting a standard solution of Zr so that the Zr concentrations varied from 1 to 200 ppm, and the calibration curve was determined by measuring the amounts of Zr in the diluted solutions. Note that the common procedures related to the ICP are based on JIS K 0116-1995 (General Rules for Emission Spectrometry) and JIS Z 8002-1991 (General Rules for Tolerances of Tests and Analyses).

Next, the structure of a steel bar or wire rod according to the present invention is explained hereafter.

The present inventors studied methods of enhancing the ductility of a steel bar or wire rod for cold forging and made it clear that the key to enhancing the ductility of a spheroidizing-annealed steel material was to make the spheroidizing-annealed structure homogeneous and fine, and that, for this end, it was effective to control the percentage of ferrite in the structure after hot rolling to a specified figure or less and to make the balance a mixed structure consisting of one or more of fine martensite, bainite and pearlite. It follows that the ductility of a steel bar or wire rod increases when it is rapidly cooled after finish hot rolling and then spheroidizing-annealed. If it is rapidly cooled so as to harden the structure throughout its section, however, quenching cracks are likely to occur and, besides, steel hardness does not decrease even after the spheroidizing annealing and cold deformation resistance increases, which makes the service life of cold forging dies shorter. The present inventors discovered: that, for solving the above problem, it was effective to temper the martensite formed in the surface layer of a steel bar or wire rod by rapidly cooling the surface layer after finish hot rolling and subsequently making it recuperate by the sensible heat thereof and, by doing so, to soften the surface layer prior to spheroidizing annealing, and further to make the internal portion composed of a soft structure by making use of the low cooling rate; and that, as a result of the above, a steel bar or wire rod for cold forging excellent in ductility after spheroidizing annealing and having a low cold deformation resistance could be obtained.

FIG. 1 is a graph showing the relation between the position (mm, 0 at the center) in a section of a steel bar 36 mm in diameter for cold forging according to the present invention and the hardness (HV) at the position.

As seen in FIG. 1, the average hardness at the surface is HV 280 to 330 and that at the center is roughly HV 200, and the hardness decreases gradually towards the center.

Figure 2A:
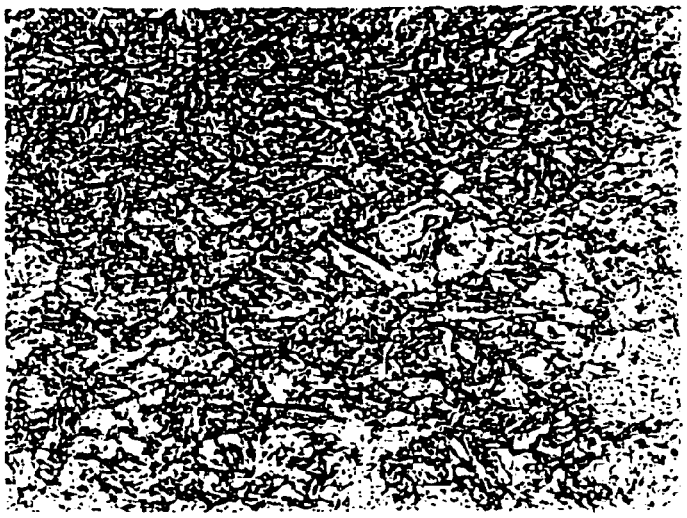
FIG. 2(*a*) is a micrograph (×400) of the surface of a steel bar and FIG. 2(*b*) a micrograph (×400) of the center portion thereof.
Figure 2B:
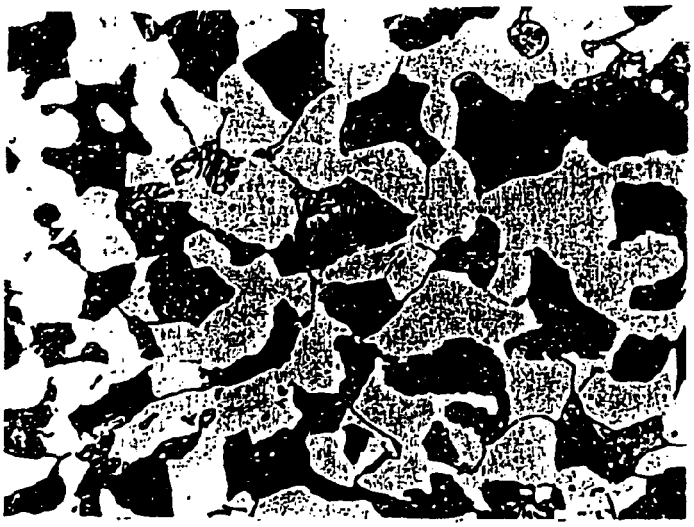

As seen in the micrograph (×400) of the surface of the steel bar in FIG. 2(*a*) and that of the center in FIG. 2(*b*), the structure at the surface consists mainly of tempered martensite and that at the center mainly of ferrite and pearlite.

Figure 3A:
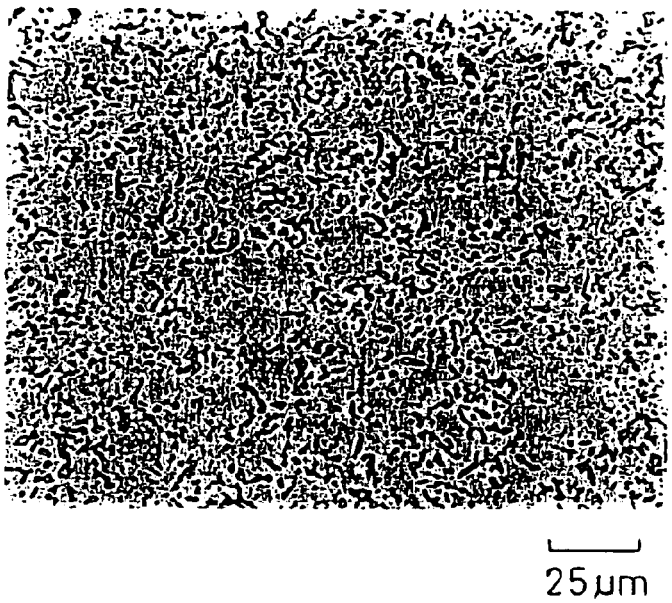
FIG. 3(*a*) is a micrograph (×400) of the surface of a steel bar obtained through the spheroidizing annealing of the steel bar shown in FIG. 1, and FIG. 3(*b*) a micrograph (×400) of the center portion thereof.
Figure 3B:
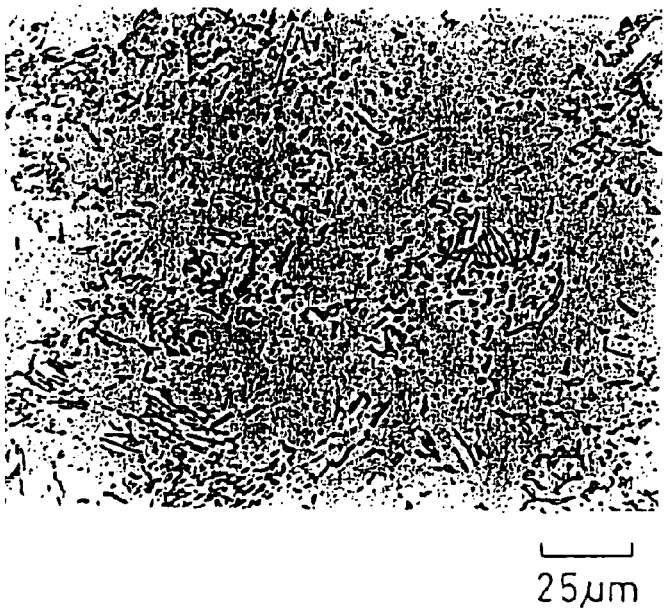

As for the structure after the spheroidizing annealing to hold the steel bar shown in FIG. 1 at 735° C. for 1 h. and then at 680° C. for 2 h., as is clear from the micrograph (×400) of the surface of the steel bar in FIG. 3(*a*) and that of the center in FIG. 3(*b*), a homogeneous structure having a good degree of spheroidizing is obtained at the surface. The hardness after the spheroidizing annealing is about HV 135, roughly the same from the surface to the center.

Even though a steel bar after spheroidizing annealing is subjected to an upsetting test under heavy working of a true strain exceeding 1, it did not develop any cold forging cracks and its cold deformation resistance remained at a low level not causing any problem during cold forging work.

Based on this result, the present inventors further proceeded with tests and examinations into the structure of the surface layer and the relation between the hardness of the surface layer and that of the center portion not causing cracking at cold forging work.

As a result, the present inventors discovered: that, even if the surface layer was composed of a tempered martensite structure (a structure in which ferrite exists in a phase consisting substantially of one or more of martensite, bainite and pearlite), the cold forging cracks could not be prevented from occurring unless the area percentage of ferrite was 10% or less in the portion of a steel bar or wire rod from the surface to the depth of 0.15 of its diameter, or, preferably 5% or less in the case of heavy cold forging work; that, in order to secure the ductility during cold forging and prevent cracks from occurring and deformation resistance from increasing, it was necessary to form a fine and homogeneous structure having a higher percentage of tempered martensite in the surface layer at the stage after the steel bar or wire rod was hot-rolled; and that, for this end, it was necessary to create difference in hardness between the surface layer and the center portion at the stage after the steel bar or wire rod was hot-rolled and the necessary condition for achieving the above was to make the average hardness (HV) of the portion from the depth of 0.5 of the radius of the steel bar or wire rod to its center lower than the average hardness (HV) of the portion from the surface to the depth of 0.15 of the radius by HV 20 or more, or, preferably by HV 50 or more in the case of heavy cold forging work.

Then, when the steel bar or wire rod described above was subjected to spheroidizing annealing (SA), a steel bar or wire rod for cold forging excellent in ductility was obtained, wherein the degree of spheroidized structure defined by JIS G 3539 in the portion of the steel bar or wire rod from the surface to the depth of 0.15 of its radius was No. 2 or below. It was confirmed that the spheroidizing-annealed steel bar or wire rod thus obtained did not develop cold forging cracks even though it was subjected to an upsetting test under heavy working of a true strain exceeding 1.

Note that the conventionally known methods of spheroidizing annealing can be employed for the spheroidizing annealing of the present invention.

In order to obtain the grain size of the crystals in the surface layer contributing to the enhancement of ductility, at the stage before the spheroidizing annealing, it is enough to make the austenite crystal grain size number under JIS G 0551 not less than 8 in the portion of the steel bar or wire rod from the surface to the depth of 0.15 of its radius. Here, it is preferable to make the number not less than 9 when better properties are required, or not less than 10 when still higher properties are required. Then, at the stage after the spheroidizing annealing, it is enough to make the ferrite crystal grain size number under JIS G 3545 not less than 8 in the portion of the steel bar or wire rod from the surface to the depth of 0.15 of its radius, and it is preferable to make the number not less than 9 when better properties are required, or not less than 10 when still higher properties are required.

When the crystal grain size numbers are not more than the numbers specified above, sufficient ductility is not achieved.

Next, a method of producing the steel bar or wire rod for cold forging according to the present invention is explained hereafter.

Figure 4:
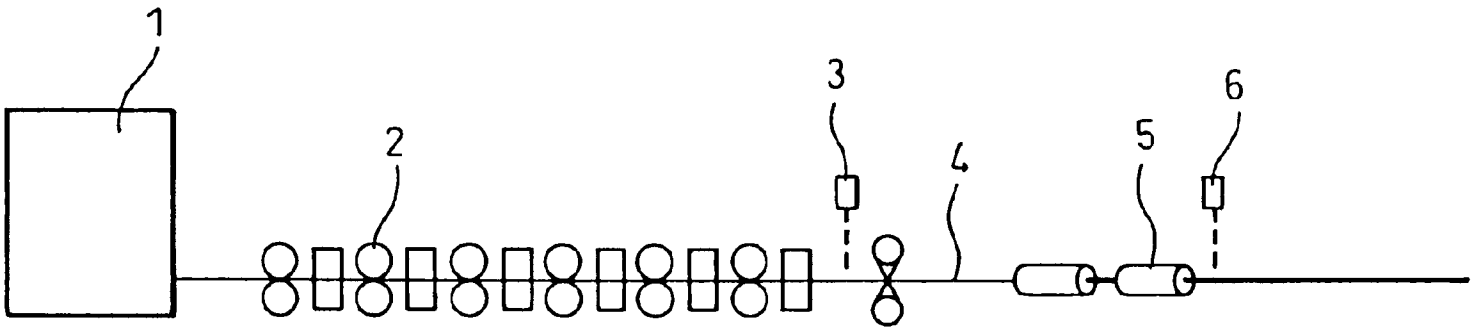
FIG. 4 is a schematic illustration showing the example of a rolling line employed for the present invention.

FIG. 4 is a schematic illustration showing the example of a rolling line employed in the present invention.

As seen in FIG. 4, a steel having a chemical composition according to any one of claims 1 to 5 is heated in a reheating furnace 1 and finish-rolled through a hot rolling mill 2 so that the surface temperature of the steel bar or wire rod is controlled to 700 to 1,000° C. at the exit from the final finish rolling stand. The temperature at the exit from the final finish rolling stand is measured with a pyrometer 3. Then, the finish-rolled steel bar or wire rod 4 is rapidly cooled by applying water to the surface in the cooling troughs 5 (preferably, at an average cooling rate of 30° C./sec. or higher, for example) to a surface temperature of 600° C. or lower, preferably 500° C. or lower or, more preferably 400° C. or lower, so that the structure of the surface layer consists mainly of martensite. After passing through the cooling troughs, the surface layer of the steel bar or wire rod is recuperated by the sensible heat of its center portion to a surface temperature of 200 to 700° C. (measured with a pyrometer 6) so that the structure of the surface layer consists mainly of tempered martensite.

In the present invention, the above rapid cooling and recuperating process is conducted at least once or more. This remarkably enhances the ductility of a steel.

The reason why the surface temperature of the steel bar or wire rod is controlled to 700 to 1,000° C. is that crystal grains can be made fine through low temperature rolling and, by so doing, the structure after the rapid cooling can be made fine: when the surface temperature is 1,000° C. or lower, the austenite grain size number in the surface layer becomes 8; when it is 950° C. or lower, the number becomes 9; and when it is 860° C. or lower, the number becomes 10. When the surface temperature is below 700° C., however, it becomes difficult to reduce the quantity of ferrite in the structure of the surface layer, and, for his reason, the surface temperature must be 700° C. or above.

Note that a method and an apparatus of such direct surface quenching (DSQ) are publicly known as disclosed in Japanese Unexamined Patent Publication Nos. S62-13523 and H1-25918, though the object to which they are applied is other than that of the present invention.

Figure 5A:
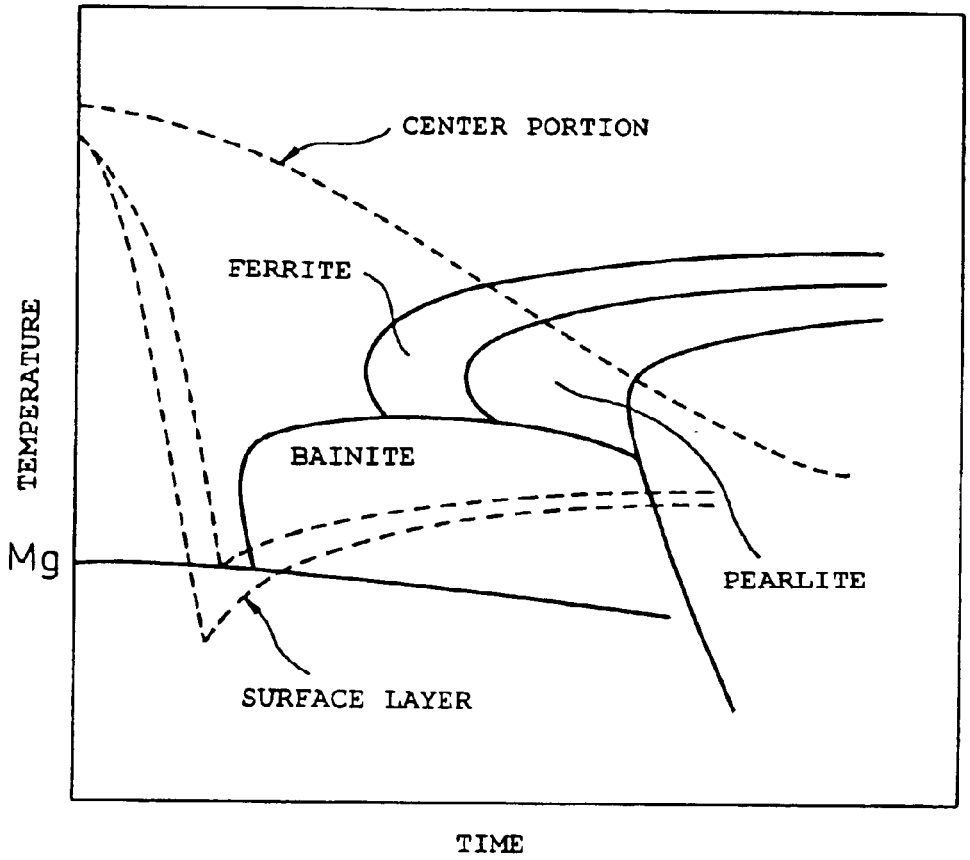
FIG. 5(*a*) is a diagram showing CCT curves to explain the structures in the surface layer and the center portion of a steel bar or wire rod, and FIG. 5(*b*) a sectional view showing the structure of a steel bar or wire rod after cooling and recuperating.
Figure 5B:
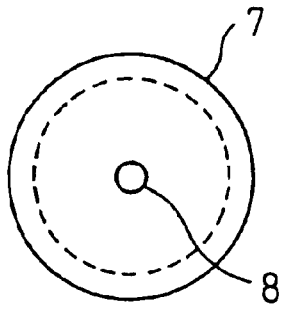

FIG. 5 is a diagram showing CCT curves for explaining the structures of the surface layer and the center portion of a steel bar or wire rod.

As shown in the figure, when a steel bar or wire rod finish-rolled at a low temperature is rapidly cooled and then recuperated, the structure of the surface layer 7, which is cooled at a high cooling rate, mainly consists of tempered martensite, while that of the center portion 8, which is cooled at a lower cooling rate than the surface layer, consists of ferrite and pearlite.

The reason why a steel bar or wire rod is rapidly cooled to a surface temperature of 600° C. or below and then it is recuperated by the sensible heat to a surface temperature of 200 to 700° C. is to make the surface layer consist of a structure mainly composed of tempered martensite and having a reduced hardness.

EXAMPLE

Examples of the present invention are explained hereafter.

The steels listed in Table 1 were rolled into steel bars and wire rods under the rolling conditions listed in Table 2. The diameter of the rolled products ranged from 36 to 55 mm. After that, the steel bars and wire rods underwent spheroidizing annealing and then a hardening treatment through quenching and tempering. The structures and properties of the steel bars and wire rods were investigated at the stages right after rolling, after spheroidizing-annealing and after quenched and tempered, respectively. The results are shown in Tables 3 and 4. "The portion of a steel bar or wire rod from the surface to the depth of 0.15 of the radius" referred to in the claims of the present invention is expressed in Tables 3 and 4 simply as "surface layer" (e.g., surface layer hardness). Likewise, "the portion of a steel bar or wire rod from the depth of 0.5 of the radius to the center" referred to in the claims of the present invention is expressed in the tables simply as "center portion" (e.g., center portion hardness). The deformation resistance of each of the steel bars and wire rods was measured by subjecting the columnar test piece having the same diameter as the rolled product and a height 1.5 times the diameter to the upsetting test. A critical upsetting ratio was measured by subjecting each of the columnar test pieces of the aforementioned dimension, each having a notch 0.8 mm in depth and 0.15 mm in notch apex radius at the surface, to the upsetting test. The test pieces for tensile test were cut out from the positions corresponding to the surface layers of the rolled products, and the tensile strength and reduction of area, which is an indicator of ductility, of the surface layers were measured through tensile test. The rolled products of each steel underwent any one of the common quenching and tempering (common QT), induction quenching and tempering (IQT) and carburizing quenching and tempering (CQT). The induction quenching was conducted at a frequency of 30 kHz. The carburizing quenching was conducted under the condition of a carbon potential of 0.8% and 950° C.×8 h.

TABLE 1

| | | | | | | | | (mass %) | | | | | | | |
|---|---|---|---|---|---|---|---|---|---|---|---|---|---|---|---|
| Steel | C | Si | Mn | S | Al | N | P | O | Ni | Cr | Mo | Nb | V | Te | Ca |
| 1 | 0.25 | 0.23 | 0.47 | 0.008 | 0.028 | 0.0035 | 0.020 | 0.0014 | — | — | — | — | — | — | — |
| 2 | 0.25 | 0.20 | 1.10 | 0.009 | 0.031 | 0.0051 | 0.009 | 0.0008 | — | — | — | — | — | — | — |
| 3 | 0.34 | 0.22 | 0.80 | 0.019 | 0.029 | 0.0042 | 0.014 | 0.0014 | — | — | — | — | — | — | — |
| 4 | 0.40 | 0.24 | 0.82 | 0.009 | 0.030 | 0.0043 | 0.012 | 0.0007 | — | — | — | — | — | — | — |
| 5 | 0.45 | 0.29 | 0.78 | 0.008 | 0.030 | 0.0051 | 0.012 | 0.0009 | — | — | — | — | — | — | — |
| 6 | 0.48 | 0.25 | 0.80 | 0.008 | 0.026 | 0.0048 | 0.008 | 0.0013 | — | — | — | — | — | — | — |
| 7 | 0.53 | 0.29 | 0.74 | 0.009 | 0.027 | 0.0050 | 0.009 | 0.0009 | — | — | — | — | — | — | — |
| 8 | 0.35 | 0.29 | 1.28 | 0.013 | 0.028 | 0.0047 | 0.009 | 0.0007 | — | — | — | — | — | — | — |
| 9 | 0.40 | 0.22 | 1.38 | 0.008 | 0.027 | 0.0045 | 0.024 | 0.0009 | — | — | — | — | — | — | — |
| 10 | 0.46 | 0.23 | 1.21 | 0.012 | 0.025 | 0.0052 | 0.012 | 0.0012 | — | — | — | — | — | — | — |
| 11 | 0.53 | 0.21 | 1.08 | 0.011 | 0.033 | 0.0048 | 0.014 | 0.0008 | — | — | — | — | — | — | — |
| 12 | 0.33 | 0.05 | 0.65 | 0.009 | 0.027 | 0.0043 | 0.008 | 0.0008 | — | 0.30 | — | — | — | — | — |
| 13 | 0.40 | 0.04 | 0.67 | 0.012 | 0.028 | 0.0045 | 0.013 | 0.0014 | — | 0.45 | — | — | — | — | — |
| 14 | 0.44 | 0.05 | 0.64 | 0.008 | 0.029 | 0.0051 | 0.010 | 0.0010 | — | 0.31 | — | — | — | — | — |
| 15 | 0.53 | 0.04 | 0.65 | 0.009 | 0.031 | 0.0047 | 0.014 | 0.0009 | | 0.51 | | | | | |
| 16 | 0.40 | 0.25 | 0.82 | 0.009 | 0.030 | 0.0054 | 0.012 | 0.0013 | — | 1.06 | — | — | — | — | — |
| 17 | 0.35 | 0.23 | 0.79 | 0.007 | 0.028 | 0.0046 | 0.013 | 0.0015 | — | 1.03 | 0.17 | — | — | — | — |
| 18 | 0.32 | 0.27 | 1.31 | 0.007 | 0.028 | 0.0105 | 0.015 | 0.0014 | — | — | — | — | 0.15 | — | — |
| 19 | 0.43 | 0.23 | 1.41 | 0.008 | 0.030 | 0.0051 | 0.012 | 0.0011 | — | 0.12 | — | — | — | 0.0030 | — |
| 20 | 0.48 | 0.23 | 0.77 | 0.007 | 0.028 | 0.0058 | 0.012 | 0.0014 | — | — | — | — | — | 0.0023 | — |
| 21 | 0.35 | 0.24 | 0.81 | 0.013 | 0.027 | 0.0058 | 0.013 | 0.0014 | — | 1.01 | 0.16 | — | — | 0.0024 | — |
| 22 | 0.15 | 0.22 | 0.80 | 0.013 | 0.029 | 0.0134 | 0.014 | 0.0013 | — | 1.10 | 0.16 | — | — | — | — |
| 23 | 0.20 | 0.24 | 0.82 | 0.010 | 0.030 | 0.0152 | 0.012 | 0.0007 | — | 1.12 | — | — | — | — | — |
| 24 | 0.15 | 0.23 | 0.51 | 0.008 | 0.029 | 0.0142 | 0.012 | 0.0012 | 2.24 | 0.41 | — | — | — | — | — |
| 25 | 0.20 | 0.22 | 0.83 | 0.008 | 0.028 | 0.0152 | 0.010 | 0.0009 | 0.51 | 0.49 | 0.17 | — | — | — | — |
| 26 | 0.20 | 0.05 | 0.65 | 0.009 | 0.031 | 0.0148 | 0.012 | 0.0010 | — | 1.59 | — | — | — | — | — |
| 27 | 0.15 | 0.04 | 0.64 | 0.007 | 0.029 | 0.0140 | 0.013 | 0.0012 | — | 1.55 | 0.16 | — | — | — | — |
| 28 | 0.20 | 0.23 | 0.84 | 0.009 | 0.030 | 0.0149 | 0.013 | 0.0011 | — | 1.12 | — | 0.021 | — | — | — |
| 29 | 0.19 | 0.24 | 0.81 | 0.008 | 0.029 | 0.0152 | 0.014 | 0.0010 | — | 1.11 | 0.16 | 0.025 | — | — | — |
| 30 | 0.20 | 0.21 | 0.79 | 0.008 | 0.029 | 0.0152 | 0.013 | 0.0012 | — | 1.12 | 0.17 | 0.019 | 0.10 | — | — |
| 31 | 0.19 | 0.04 | 0.63 | 0.010 | 0.030 | 0.0145 | 0.013 | 0.0010 | — | 1.60 | — | 0.024 | — | — | — |
| 32 | 0.20 | 0.04 | 0.65 | 0.009 | 0.029 | 0.0147 | 0.011 | 0.0012 | — | 1.57 | 0.16 | 0.020 | | — | |
| 33 | 0.20 | 0.04 | 0.65 | 0.008 | 0.029 | 0.0148 | 0.011 | 0.0010 | | 0.51 | 0.72 | | 0.10 | | 0.0030 |
| 34 | 0.19 | 0.23 | 0.79 | 0.008 | 0.029 | 0.0147 | 0.012 | 0.0009 | | 1.13 | 0.03 | 0.022 | — | 0.0025 | — |

TABLE 2

| Classification | Reference symbol of rolling conditions | Steel surface temperature at exit from finish rolling stand, ° C. | Number of repetitions of rapid cooling and recuperating cycle | Surface temperature immediately after rapid cooling (Average temperature in II) | Recuperation temperature (Average temperature in II) |
|---|---|---|---|---|---|
| Invented examples | I | 790–940 | 1 cycle | Roughly 100° C. | 400–590° C. |
| | II | 770–920 | 7 | Roughly 500° C. | 380–650 |
| Comparative examples | III | 870–940 | | Air-cooled after hot rolling | |

TABLE 3

| | | | | Structure and properties of bar or wire rod | | | | | Structure and properties after spheroidizing annealing | |
|---|---|---|---|---|---|---|---|---|---|---|
| Classification | Reference symbol | Steel No. | Rolling condition | Area percentage of ferrite in surface layer, % | Surface layer hardness, HV | Center portion hardness, HV | Hardness difference between surface layer and center portion, HV | γ grain size number of surface layer | Degree of spheroidized structure of surface layer | Degree of spheroidized structure of center portion |
| Range specified in the present invention | | | | ≦10% | | | ≧20% | ≧ No. 8 | ≦ No. 2 | ≦ No. 3 |
| Example of first | 1 | 1 | I | 4 | 223 | 167 | 56 | | | |
| | 2 | 3 | I | 3 | 282 | 220 | 62 | | | |

TABLE 3-continued

| | | | | | | | | |
|---|---|---|---|---|---|---|---|---|
| invention | 3 | 6 | I | 0 | 290 | 225 | 65 | |
| | 4 | 11 | II | 0 | 319 | 248 | 71 | |
| Example of second invention | 5 | 13 | I | 0 | 292 | 225 | 67 | |
| | 6 | 15 | I | 0 | 330 | 242 | 88 | |
| Example of third invention | 7 | 18 | I | 0 | 317 | 254 | 63 | |
| Example of fourth invention | 8 | 19 | I | 0 | 294 | 224 | 70 | |
| Example of second invention | 9 | 25 | I | 0 | 365 | 256 | 109 | |
| | 10 | 26 | I | 0 | 340 | 231 | 110 | |
| Example of third invention | 11 | 28 | I | 0 | 345 | 242 | 103 | |
| | 12 | 32 | I | 3 | 297 | 220 | 77 | |
| Example of fourth invention | 13 | 33 | I | 0 | 322 | 234 | 88 | |
| Example of fifth invention | 14 | 4 | I | 0 | 293 | 226 | 67 | 9.7 |
| | 15 | 7 | I | 0 | 332 | 245 | 87 | 10.8 |
| | 16 | 9 | I | 0 | 304 | 231 | 73 | 9.5 |
| | 17 | 17 | I | 0 | 281 | 219 | 63 | 10.4 |
| | 18 | 20 | I | 0 | 290 | 223 | 67 | 9.9 |
| | 19 | 22 | I | 0 | 343 | 242 | 101 | 11.8 |
| | 20 | 30 | II | 0 | 295 | 225 | 70 | 9.2 |

| | | Structure and properties after spheroidizing annealing | | | | | | | | |
|---|---|---|---|---|---|---|---|---|---|---|
| | | | | | | | | Surface hardness after QT, HV | | |
| Classification | Reference symbol | Ferrite grain size number of surface layer | Deformation resistance, MPa | Critical upsetting ratio, % | Surface layer hardness, HV | Tensile strength, MPa | Reduction of area, % | Common QT | IQT | CQT |
| Range specified in the present invention | | ≧ No. 8 | | | | | | | | |
| Example of first invention | 1 | | 660 | 57.4 | 130 | 400 | 91 | 230 | | |
| | 2 | | 690 | 52.2 | 139 | 465 | 84 | | 620 | |
| | 3 | | 750 | 50.5 | 146 | 533 | 73 | | 650 | |
| | 4 | | 780 | 48.2 | 154 | 572 | 68 | | 692 | |
| Example of second invention | 5 | | 773 | 50.0 | 143 | 521 | 77 | | 653 | |
| | 6 | | 792 | 46.3 | 160 | 584 | 67 | | 700 | |
| Example of third invention | 7 | | 778 | 48.6 | 154 | 570 | 67 | | 624 | |
| Example of fourth invention | 8 | | 752 | 50.8 | 145 | 533 | 73 | | 653 | |
| Example of second invention | 9 | | 687 | 55.2 | 135 | 462 | 76 | | | 812 |
| | 10 | | 665 | 57.4 | 132 | 457 | 87 | | | 809 |
| Example of third invention | 11 | | 674 | 56.8 | 134 | 455 | 88 | | | 778 |
| | 12 | | 675 | 56.4 | 132 | 461 | 85 | | | 780 |
| Example of fourth invention | 13 | | 681 | 57.6 | 135 | 459 | 86 | | | 805 |
| Example of fifth invention | 14 | | 774 | 50.2 | 149 | 521 | 77 | | 656 | |
| | 15 | | 793 | 46.2 | 162 | 583 | 68 | | 698 | |
| | 16 | | 766 | 51.2 | 139 | 516 | 78 | | 662 | |
| | 17 | | 692 | 52.3 | 140 | 453 | 83 | | 618 | |
| | 18 | | 749 | 51.3 | 145 | 532 | 75 | | 653 | |
| | 19 | | 677 | 57.2 | 136 | 453 | 87 | | | 802 |
| | 20 | | 674 | 56.6 | 134 | 462 | 83 | | | 795 |

Common QT: Quenching after heating to 900° C. and tempering at 550° C.;
IQT: induction quenching and tempering at 170° C.;
CQT: carburization quenching and tempering at 170° C.

TABLE 4

| Classification | Reference symbol | Steel No. | Rolling condition | Structure and properties of bar or wire rod: Area percentage of ferrite in surface layer, % | Surface layer hardness, HV | Center portion hardness, HV | Hardness difference between surface layer and center portion, HV | γ grain size number of surface layer | Structure and properties after spheroidizing annealing: Degree of spheroidized structure of surface layer | Degree of spheroidized structure of center portion |
|---|---|---|---|---|---|---|---|---|---|---|
| Range specified in the present invention | | | | ≦10% | | | ≧20% | ≧ No. 8 | ≦ No. 2 | ≦ No. 3 |
| Example of seventh invention | 21 | 2 | I | 0 | 281 | 220 | 61 | | 1 | 2 |
| | 24 | 10 | I | 0 | 292 | 223 | 69 | | 1 | 2 |
| | 25 | 12 | I | 0 | 284 | 221 | 63 | | 1 | 2 |
| | 27 | 16 | I | 0 | 295 | 227 | 68 | | 1 | 2 |
| | 29 | 23 | I | 0 | 361 | 252 | 109 | | 1 | 2 |
| | 31 | 27 | I | 0 | 343 | 230 | 113 | | 1 | 2 |
| | 33 | 31 | II | 0 | 315 | 230 | 85 | | 1 | 2 |
| Example of eighth invention | 22 | 5 | I | 0 | 286 | 205 | 81 | | 1 | 2 |
| | 23 | 8 | I | 0 | 284 | 219 | 65 | | 1 | 2 |
| | 26 | 14 | I | 0 | 287 | 206 | 81 | | 1 | 2 |
| | 28 | 21 | I | 0 | 318 | 225 | 93 | | 1 | 2 |
| | 30 | 24 | I | 0 | 357 | 243 | 114 | 10.4 | 1 | 2 |
| | 32 | 29 | II | 0 | 360 | 258 | 102 | | 1 | 2 |
| | 34 | 34 | I | 0 | 345 | 240 | 105 | 9.8 | 1 | 2 |
| Comparative examples | 35 | 5 | III | 45 | 186 | 180 | 6 | | 3 | 4 |
| | 36 | 23 | III | 54 | 195 | 187 | 8 | | 3 | 4 |
| | 37 | 22 | III | 26 | 230 | 221 | 9 | | 3 | 3 |

| Classification | Reference symbol | Structure and properties after spheroidizing annealing: Ferrite grain size number of surface layer | Deformation resistance, MPa | Critical upsetting ratio, % | Surface layer hardness, HV | Tensile strength, MPa | Reduction of area, % | Surface hardness after QT, HV: Common QT | IQT | CQT |
|---|---|---|---|---|---|---|---|---|---|---|
| Range specified in the present invention | | ≧ No. 8 | | | | | | | | |
| Example of seventh invention | 21 | | 658 | 58.8 | 132 | 402 | 90 | 233 | | |
| | 24 | | 778 | 49.4 | 157 | 563 | 70 | | 682 | |
| | 25 | | 689 | 53.1 | 140 | 463 | 83 | | 622 | |
| | 27 | | 772 | 50.4 | 142 | 523 | 79 | | 659 | |
| | 29 | | 685 | 55.8 | 133 | 458 | 87 | | | 804 |
| | 31 | | 657 | 57.0 | 130 | 454 | 87 | | | 811 |
| | 33 | | 669 | 56.3 | 135 | 456 | 86 | | | 794 |
| Example of eighth invention | 22 | 10.5 | 739 | 52.3 | 142 | 512 | 77 | | 639 | |
| | 23 | 10.6 | 688 | 52.3 | 142 | 468 | 86 | | 622 | |
| | 26 | 9.8 | 742 | 52.2 | 145 | 528 | 75 | | 641 | |
| | 28 | 10.2 | 762 | 51.3 | 147 | 530 | 74 | | 652 | |
| | 30 | 9.9 | 686 | 55.2 | 132 | 462 | 85 | | | 803 |
| | 32 | 10.3 | 662 | 57.4 | 132 | 457 | 87 | | | 801 |
| | 34 | 9.5 | 673 | 56.6 | 136 | 455 | 87 | | | 782 |
| Comparative examples | 35 | | 730 | 37.4 | 140 | 510 | 62 | | 561 | |
| | 36 | | 681 | 41.0 | 131 | 454 | 71 | | | 799 |
| | 37 | | 675 | 43.4 | 132 | 451 | 74 | | | 804 |

Common QT: Quenching after heating to 900° C. and tempering at 550° C.;
IQT: induction quenching and tempering at 170° C.;
CQT: carburization quenching and tempering at 170° C.

As is clear from Tables 3 and 4, the samples according to the present invention are remarkably better in the critical upsetting ratio and the reduction of area, which are indicators of steel ductility, than the comparative samples having the same carbon contents, and their deformation resistance and the hardness after the quenching and tempering are satisfactory.

Next, the steels listed in Table 5 were rolled into steel bars and wire rods 36 to 50 mm in diameter under the rolling conditions listed in Table 2, spheroidizing-annealed, and then hardened through quenching and tempering in the same manner as above. Table 6 shows the investigation results of their structures and material properties. Comparing the samples of Table 6 with the comparative samples of Table 4, the samples according to the present invention are remarkably better in the critical upsetting ratio and the reduction of area, which are indicators of steel ductility, than the comparative samples having the same carbon contents, and their deformation resistance and the hardness after the quenching and tempering are satisfactory.

TABLE 5

| Steel | C | Si | Mn | S | Al | N | P | O | Cr | Mo | Nb | Te | Zr | Mg | Y | Rare earth element |
|---|---|---|---|---|---|---|---|---|---|---|---|---|---|---|---|---|
| 41 | 0.35 | 0.25 | 0.81 | 0.014 | 0.034 | 0.0054 | 0.015 | 0.0015 | — | — | — | — | 0.0027 | — | — | — |
| 42 | 0.44 | 0.24 | 0.80 | 0.008 | 0.028 | 0.0053 | 0.012 | 0.0009 | — | — | — | 0.0031 | 0.0018 | 0.0145 | — | — |
| 43 | 0.45 | 0.20 | 0.84 | 0.011 | 0.031 | 0.0057 | 0.014 | 0.0012 | — | — | — | — | — | 0.0164 | — | — |
| 44 | 0.45 | 0.15 | 0.84 | 0.009 | 0.030 | 0.0048 | 0.015 | 0.0010 | — | — | — | — | — | — | — | 0.024 |
| 45 | 0.44 | 0.22 | 0.78 | 0.014 | 0.033 | 0.0060 | 0.015 | 0.0013 | — | — | — | 0.0025 | 0.0025 | — | — | — |
| 46 | 0.44 | 0.21 | 0.80 | 0.015 | 0.035 | 0.0053 | 0.014 | 0.0009 | 0.14 | — | — | — | 0.0020 | — | — | — |
| 47 | 0.35 | 0.25 | 0.82 | 0.016 | 0.030 | 0.0049 | 0.015 | 0.0009 | 1.10 | 0.16 | — | — | — | 0.0214 | — | — |
| 48 | 0.34 | 0.24 | 1.80 | 0.015 | 0.032 | 0.0051 | 0.013 | 0.0010 | 1.08 | 0.16 | — | — | 0.0034 | — | — | — |
| 49 | 0.34 | 0.25 | 0.78 | 0.009 | 0.035 | 0.0053 | 0.015 | 0.0007 | 1.21 | 0.15 | — | — | — | — | — | 0.035 |
| 50 | 0.35 | 0.23 | 0.81 | 0.014 | 0.030 | 0.0053 | 0.013 | 0.0009 | 1.12 | 0.16 | — | 0.0030 | 0.0022 | — | — | — |
| 51 | 0.35 | 0.20 | 0.82 | 0.016 | 0.033 | 0.0055 | 0.014 | 0.0010 | 1.05 | 0.17 | — | 0.0028 | 0.0024 | 0.0194 | — | — |
| 52 | 0.19 | 0.24 | 0.79 | 0.013 | 0.032 | 0.0141 | 0.015 | 0.0010 | 1.11 | 0.17 | — | — | 0.0020 | — | — | — |
| 53 | 0.20 | 0.21 | 0.81 | 0.011 | 0.030 | 0.0139 | 0.012 | 0.0014 | 1.21 | — | — | — | — | 0.0178 | — | — |
| 54 | 0.19 | 0.25 | 0.80 | 0.014 | 0.030 | 0.0150 | 0.013 | 0.0012 | 1.21 | — | 0.021 | — | 0.0021 | — | — | — |
| 55 | 0.21 | 0.20 | 0.85 | 0.011 | 0.034 | 0.0161 | 0.013 | 0.0011 | 1.13 | 0.16 | 0.021 | — | — | 0.0172 | — | — |
| 56 | 0.20 | 0.22 | 0.81 | 0.008 | 0.035 | 0.0147 | 0.014 | 0.0014 | 1.10 | 0.17 | 0.025 | — | — | — | — | 0.028 |
| 57 | 0.45 | 0.24 | 0.82 | 0.014 | 0.036 | 0.0048 | 0.014 | 0.0009 | 0.12 | — | — | — | — | — | 0.016 | — |

TABLE 6

| | | | | Structure and properties of bar or wire rod | | | | | Structure and properties after spheroidizing annealing | |
|---|---|---|---|---|---|---|---|---|---|---|
| | | | | | | | Hardness | | | |
| Classification | Reference symbol | Steel No. | Rolling condition | Area percentage of ferrite in surface layer, % | Surface layer hardness, HV | Center portion hardness, HV | difference between surface layer and center portion, HV | γ grain size number of surface layer | Degree of spheroidized structure of surface layer | Degree of spheroidized structure of center portion |
| Range specified in the present invention | | | | ≦10% | | | ≧20% | ≧ No. 8 | ≦ No. 2 | ≦ No. 3 |
| Example of fourth invention | 41 | 41 | I | 4 | 278 | 214 | 64 | | | |
| | 42 | 45 | I | 0 | 284 | 204 | 80 | | | |
| | 43 | 46 | I | 0 | 282 | 201 | 81 | | | |
| | 44 | 47 | I | 0 | 321 | 227 | 94 | | | |
| | 45 | 52 | I | 0 | 339 | 239 | 100 | | | |
| Example of fifth invention | 46 | 44 | I | 0 | 291 | 202 | 89 | 9.7 | | |
| | 47 | 49 | I | 0 | 324 | 227 | 97 | 10.9 | | |
| | 48 | 51 | I | 0 | 322 | 227 | 95 | 11.4 | | |
| | 49 | 53 | I | 0 | 374 | 254 | 120 | 10.8 | | |
| | 50 | 56 | I | 0 | 337 | 238 | 99 | 11.8 | | |
| Example of seventh invention | 51 | 42 | I | 0 | 289 | 203 | 86 | | 1 | 2 |
| | 52 | 50 | I | 0 | 312 | 227 | 85 | | 1 | 2 |
| | 53 | 55 | I | 0 | 340 | 241 | 99 | | 1 | 2 |
| Example of eighth invention | 54 | 45 | I | 0 | 291 | 202 | 89 | | 1 | 2 |
| | 55 | 48 | I | 0 | 312 | 223 | 89 | 11.2 | 1 | 2 |
| | 56 | 54 | I | 0 | 352 | 241 | 111 | | 1 | 2 |
| | 57 | 57 | I | 0 | 291 | 201 | 90 | 9.9 | 1 | 2 |

TABLE 6-continued

| Classification | Reference symbol | Structure and properties after spheroidizing annealing: Ferrite grain size number of surface layer | Deformation resistance, MPa | Critical upsetting ratio, % | Surface layer hardness, HV | Tensile strength, MPa | Reduction of area, % | Surface hardness after QT, HV: Common QT | IQT | CQT |
|---|---|---|---|---|---|---|---|---|---|---|
| Range specified in the present invention | | ≧ No. 8 | | | | | | | | |
| Example of fourth invention | 41 | | 688 | 52.4 | 137 | 469 | 85 | | 621 | |
| | 42 | | 740 | 5.26 | 143 | 514 | 78 | | 642 | |
| | 43 | | 736 | 52.5 | 140 | 513 | 78 | 274 | | |
| | 44 | | 758 | 50.8 | 145 | 528 | 72 | 285 | | |
| | 45 | | 675 | 58.8 | 138 | 449 | 86 | | | |
| Example of fifth invention | 46 | | 736 | 52.0 | 143 | 521 | 76 | | 639 | |
| | 47 | | 759 | 50.7 | 142 | 532 | 73 | | 652 | |
| | 48 | | 758 | 51.1 | 144 | 528 | 74 | 294 | | |
| | 49 | | 683 | 55.4 | 135 | 459 | 85 | | | 800 |
| | 50 | | 679 | 57.7 | 138 | 455 | 87 | | | 811 |
| Example of seventh invention | 51 | | 741 | 52.8 | 144 | 514 | 78 | | 640 | |
| | 52 | | 758 | 51.7 | 146 | 532 | 73 | 276 | | |
| | 53 | | 675 | 58.0 | 137 | 454 | 89 | | | 792 |
| Example of eighth invention | 54 | 10.0 | 741 | 52.7 | 145 | 514 | 76 | | 643 | |
| | 55 | 10.4 | 780 | 51.8 | 145 | 532 | 75 | 287 | | |
| | 56 | 9.8 | 681 | 56.1 | 135 | 457 | 88 | | | 810 |
| | 57 | 10.1 | 735 | 53.1 | 145 | 523 | 77 | | 642 | |

Common QT: Quenching after heating to 900° C. and tempering at 550° C.;
IQT: induction quenching and tempering at 170° C.;
CQT: carburization quenching and tempering at 170° C.

Industrial Applicability

A steel bar or wire rod for cold forging according to the present invention is a steel bar or wire rod for cold forging excellent in ductility after spheroidizing annealing, capable of preventing the steel material from cracking during cold forging, which cracking has conventionally constituted a problem in the cold forging after spheroidizing annealing. As the present invention makes it possible to manufacture forged machine components requiring heavy working by cold forging thanks to the above, it brings about remarkable advantages in significantly enhancing productivity and saving energy.

What is claimed is:

1. A steel bar or wire rod for cold forging excellent in ductility after spheroidizing annealing, characterized by: consisting of a steel containing, in mass, 0.1 to 0.6% of C, 0.01 to 0.5% of Si, 0.2 to 1.7% of Mn, 0.001 to 0.15% of S, 0.015 to 0.05% of Al and 0.003 to 0.025% of N, and having the contents of P and O controlled to 0.035% or less and 0.003% or less, respectively, with the balance consisting of Fe and unavoidable impurities; the area percentage of ferrite in the metallographic structure of the portion from the surface to the depth of 0.15 of its radius being 10% or less, with the rest of the structure consisting substantially of one or mote of martensite, bainite and pearlite; and the average hardness of the portion from the depth of 0.5 of its radius to the center being lower than that of its surface layer (the portion from, the surface to the depth of 0.15 of the radius) by HV 20 or more.

2. A steel bar or wire rod for cold forging excellent in ductility after spheroidizing annealing according to claim 1, characterized by further containing, in moss, one or more of:

3.5% or less of Ni,

2% or less of Cr and

1% or less of Mo.

3. A steel bar or wire rod for cold forging excellent in ductility after spheroidizing annealing according to claim 1, characterized by further containing, in mass, one or more of:

0.005 to 0.1% of Nb and 0.03 to 0.3% of V.

4. A steel bar or wire rod for cold forging excellent in ductility after spheroidizing annealing according to claim 1, characterized by further containing, in mass, one or more of:

0.02% or less of Te, 0.02% or less of Ca, 0.01% or less of Zr, 0.035% or less of Mg, 0.1% or less of Y and 0.15% or less of rare earth elements.

5. A teal bar or wire rod for cold forging excellent in ductility after spheroidizing annealing according to claim 1, characterized in that the austenite grain size number according to Japanese Industrial Standard (JIS) in the portion from the surface to the depth of 0.15 of its a radius is 8 or higher.

6. A method of producing a steel bar or wire rod for cold forging excellent in ductility after spheroidizing annealing, characterized by: finish-rolling a steel material having a chemical composition specified in claim 1 while controlling its surface temperature to 700 to 1,000° C. at the exit from the final finish rolling stand, during hot rolling, and, after that, subjecting the roiled material to at least a process cycle of "rapidly cling the hot rolled malarial to a surface temperature of 600° C. or below and subsequently making it recuperate by the sensible heat thereof so that the surface temperature becomes 200 to 700° C." or repeating the process cycle twice or more; and, by doing so, making the area percentage of ferrite in the structure of the portion of the steel bar or wire rod from the surface to the depth of 0.15 of its radius 10% or less, and the rest of the structure consist substantially of one or more of martensite, bainite and pearlite, and also, forming the structure in which the average hardness of the portion from the depth of 0.5 of its radius to the center is lower than that of its surface layer (the portion from the surface to the depth of 0.15 of the radius) by HV 20 or more.

7. A steel bar or wire rod for cold forging excellent, in ductility characterized by: being a feel bar or wire rod according to claim 1 having undergone spheroidizing annealing; the degree of spheroidized structure according to JIS G 3539 in the portion from the surface to the depth of 0.15 of its radius being No. 2 or below; and the degree of spheroidized structure in the portion from the depth of 0.5 of its radius to the center being No. 3 or below.

8. A steel oar or wire rod for cold forging excellent in ductility according to claim 7, characterized in that the ferrite grain size number under JIS in the portion from the surface to the depth of 0.15 of its radius is 8 or higher.

* * * * *

UNITED STATES PATENT AND TRADEMARK OFFICE

CERTIFICATE OF CORRECTION

PATENT NO. : 6,866,724 B2
DATED : March 15, 2005
INVENTOR(S) : Ochi et al.

It is certified that error appears in the above-identified patent and that said Letters Patent is hereby corrected as shown below:

Column 17,
Line 63, change “mote” to -- more --.

Column 18,
Line 37, change “moss” to -- mass --.
Line 57, change “teal” to -- steel --.
Line 61, change “of its a radius to” to -- of its radius --.

Column 19,
Line 1, change “roiled” to -- rolled --.
Line 2, change “cling the hot rolled malarial” to -- cooling the hot rolled material --.

Column 20,
Line 1, change “excellent, in” to -- excellent in --.
Line 2, change “feel” to -- steel --.
Line 10, change “oar” to -- bar --.

Signed and Sealed this

Twenty-second Day of November, 2005

JON W. DUDAS
*Director of the United States Patent and Trademark Office*